US008390217B2

(12) United States Patent
Casoli

(10) Patent No.: US 8,390,217 B2
(45) Date of Patent: Mar. 5, 2013

(54) EXTRACTOR HOOD, IN PARTICULAR FOR DOMESTIC ENVIRONMENTS

(75) Inventor: Francesco Casoli, Fabriano (IT)

(73) Assignee: Elica S.p.A., Fabriano (IT)

( * ) Notice: Subject to any disclaimer, the term of this patent is extended or adjusted under 35 U.S.C. 154(b) by 421 days.

(21) Appl. No.: 12/766,460

(22) Filed: Apr. 23, 2010

(65) Prior Publication Data

US 2010/0269815 A1 Oct. 28, 2010

(30) Foreign Application Priority Data

Apr. 28, 2009 (EP) ..... 09425162

(51) Int. Cl.
*F04D 15/00* (2006.01)
*H02K 7/14* (2006.01)

(52) U.S. Cl. ..... 318/3; 126/299 R; 126/300

(58) Field of Classification Search .. 318/3; 126/299 R, 126/300
See application file for complete search history.

(56) References Cited

U.S. PATENT DOCUMENTS

| | | | | |
|---|---|---|---|---|
| 6,104,016 | A * | 8/2000 | Lee | 219/702 |
| 6,307,343 | B1 | 10/2001 | Lee et al. | |
| 6,446,624 | B1 | 9/2002 | Chu | |
| 6,454,834 | B1 * | 9/2002 | Livingstone et al. | 95/11 |
| 6,809,678 | B2 * | 10/2004 | Vera et al. | 341/166 |

FOREIGN PATENT DOCUMENTS

| | | | |
|---|---|---|---|
| DE | 20017525 | U1 | 1/2001 |
| DE | 102005003673 | A1 | 8/2006 |
| EP | 1070920 | A1 | 1/2001 |

* cited by examiner

*Primary Examiner* — Erick Glass
(74) *Attorney, Agent, or Firm* — Pearne & Gordon LLP

(57) ABSTRACT

An extractor hood, in particular for domestic environments, comprising: a frame (10); a motor unit (19) associated with said frame (10) and designed to carry out air suction; a control unit (30) for adjusting at least operation of said motor unit (19); a feeding circuit (50) adapted to be connected to an external supply mains (60) for receiving electric power from said mains and supplying electric power at least to said motor unit (19); said feeding circuit (50) being suitable to output a predetermined power supply irrespective of the power supply provided by said supply mains (60) to said feeding circuit (50).

11 Claims, 2 Drawing Sheets

EXTRACTOR HOOD, IN PARTICULAR FOR DOMESTIC ENVIRONMENTS

FIELD OF THE INVENTION

The present invention relates to an extractor hood, in particular for domestic environments.

BACKGROUND OF THE RELATED ART

It is known that hoods are generally provided with a skirt with which air filtering means is suitably associated, together with one or more acoustic-insulation panels and at least one motor adapted to promote air suction through the filtering means and ejection of said air through ducts guiding the air to the external atmosphere out of the environment where the hood is.

In hoods of known type, the motor therein used is typically connected, for power supply, to the supply mains in a substantially direct manner. Said motor is also associated with a control unit that, depending on possible commands imparted by a user, carries out adjustment of the operation intensity of the motor itself, through one or more switches for example that are used for determining the available motor power. The motor is sized in such a manner that it can have different windings inside it, which windings if powered in a selective manner, allow different rotations speeds to be achieved by the motor.

A drawback characterising the presently available hoods relates to the fact that the different electric elements included in the hood (such as said motor, for example) must be made and sized in a specific manner, depending on the features of the supply mains utilised in the geographic area where said hood will be used.

By way of example, in a hood manufactured for a given Country, the electric components are to be made so that they can be powered with 120 V, 60 Hz alternating current (AC).

Vice versa, a hood intended for the market of a different Country must be able to accept a 230 V, 50 HZ AC power supply as an input.

The above involves clear disadvantages in terms of complexity for the manufacture of the hood structures that must be adapted to accomplishment of different products depending on the markets for which they are intended.

Further disadvantages relate to the industrial management, logistics, interventions after sale and management of the spare parts, which are clearly made difficult and complicated due to the different goods lines having electric features different from each other.

Accordingly, it is an aim of the present invention to make available an extractor hood, in particular for domestic environments, operation of which is independent of the voltage/frequency features of the supply mains of the Country in which the hood has to be marketed.

Another aim of the invention is to provided an extractor hood for which a single common platform is required for products intended for different markets.

It is a further aim of the invention to make available an extractor hood allowing big savings in terms of industrial management, logistics, interventions after sale and management of the spare parts.

An auxiliary aim of the invention is to provide an extractor hood characterised by a high electric efficiency.

Another auxiliary aim of the invention is to make available an extractor hood allowing big energy savings, both in a stand-by condition and in a condition of normal working.

SUMMARY OF THE INVENTION

The foregoing and still further aims are substantially achieved by an extractor hood, in particular for domestic environments, in accordance with the features recited in the appended claims.

Further features and advantages will become more apparent from the description of a preferred but not limiting embodiment of an extractor hood in accordance with the present invention.

BRIEF DESCRIPTION OF THE DRAWINGS

This description will be taken hereinafter with reference to the accompanying drawings, given by way of non-limiting example, in which.

DETAILED DESCRIPTION OF THE PREFERRED EMBODIMENTS OF THE INVENTION

Figure 1:
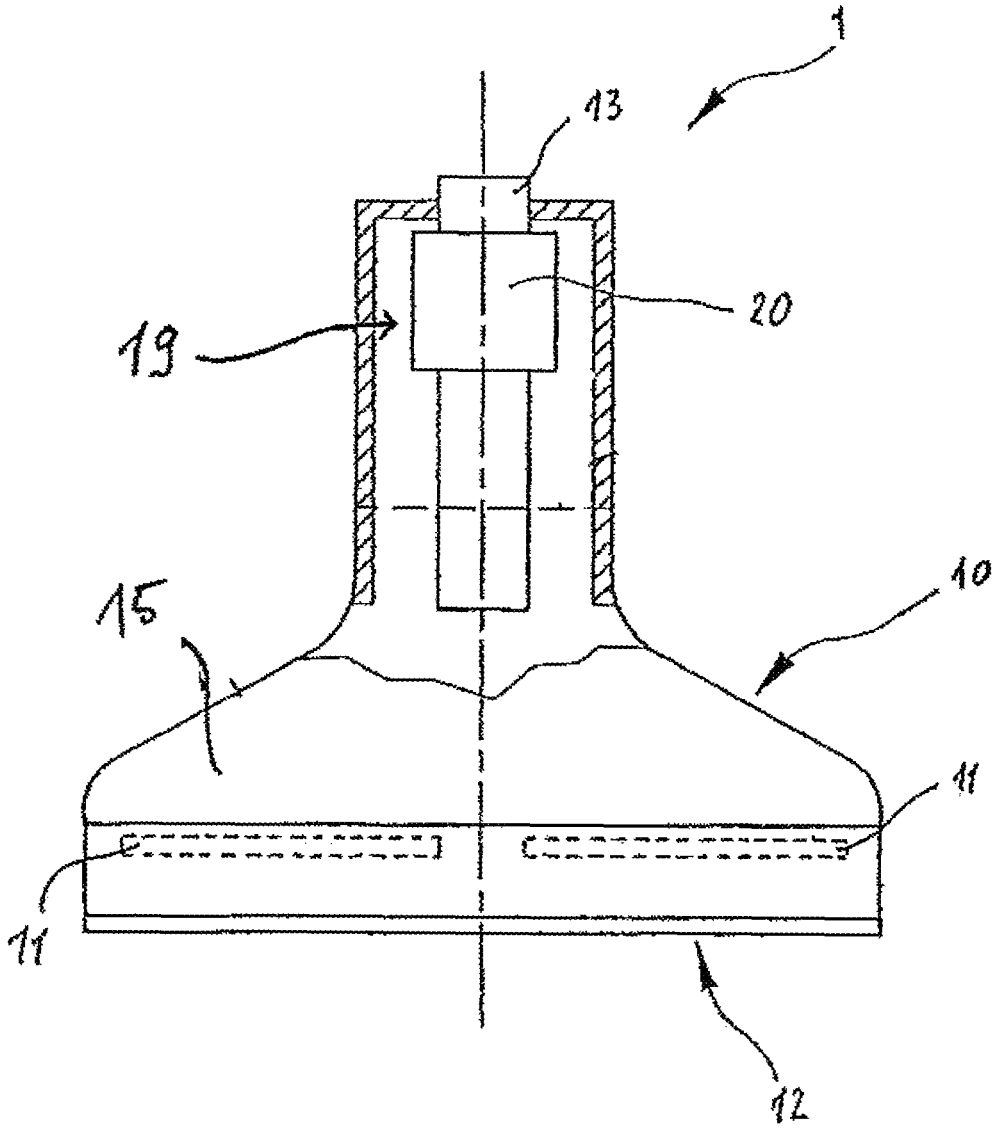
FIG. 1 diagrammatically shows a front view of an extractor hood in accordance with the invention, partially in section.

With reference to the drawings, an extractor hood in particular for domestic environments, in accordance with the present invention has been generally identified by reference numeral 1.

Hood 1 first of all comprises a frame 10, with which air filtering means 11 can be suitably associated, as well as possibly one or more acoustic-insulation panels 12 and an aesthetic body or skirt 15.

Hood 1 is such configured that the filtering means 11 filter the sucked air, and the possibly present acoustic-insulation panels allow a reduction in the noise caused by the hood during operation.

Hood 1 is further provided with a working unit or motor unit 19 associated with frame 10, adapted to promote suction of the air.

Through suitable ducts 13, the sucked air is then guided to the outside of the environment where the hood is located.

Preferably, the working unit 19 comprises a motor 20 that can be an electric motor; by way of example, this electric motor can belong to one or more of the following categories:

- an AC or a DC motor;
- a synchronous or an asynchronous motor;
- a motor with or without permanent magnets;
- an electronic-switching motor or a motor drivable without electronic switching;
- a brushless motor or a motor with brushes;
- an induction motor or a motor without armature;
- a frequency-controlled motor;
- a voltage-controlled motor;
- a current-controlled motor.

The motor 20 used can be sized in such a manner that it can work to a Safety Extra Low Voltage (SELV).

It should be noted that in the present context reference is made, for the sake of simplicity, to a single motor 20. However, it is pointed out that hood 1 can also be equipped with several motors, each substantially having the same features as those described with reference to motor 20 under discussion.

Figure 2:
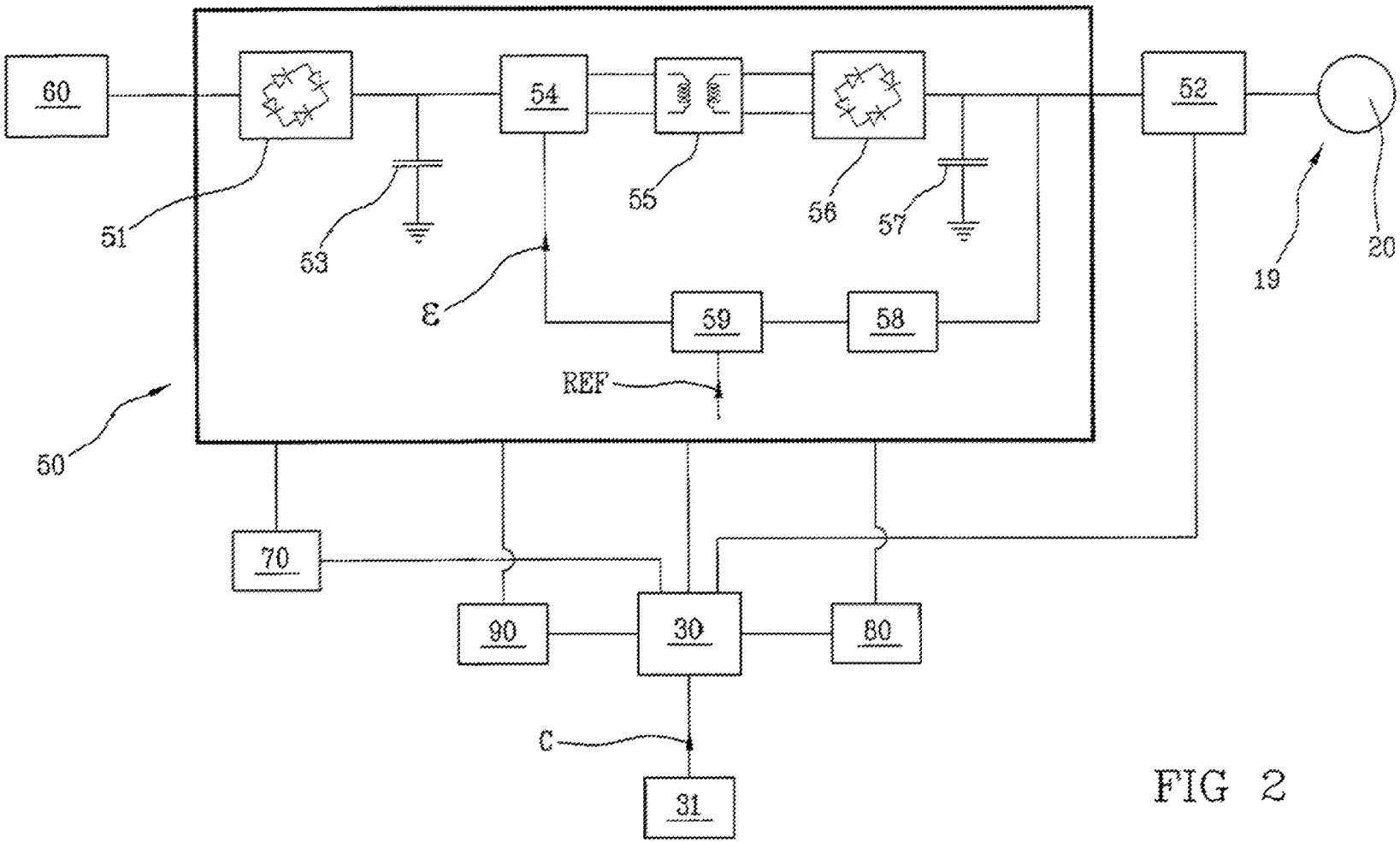
FIG. 2 is a block diagram of part of the hood seen in FIG. 1.

Hood 1 further comprises a control unit 30 (FIG. 2), for at least adjusting operation of said motor 20. In particular, the control unit 30 can be configured for adjusting the operation intensity of said motor 20.

By way of example only, different operation intensities can be provided, i.e. different suction intensities of hood 1 corresponding to distinct operation/feeding modes of motor 20; also provided is a system capable of varying the operating modes of the motor unit in a continuous manner.

Preferably, the control unit 30 carries out adjustment of operation, and in particular of the suction intensity of motor 20, as a function of a command C inputted by a user, and correspondingly adjusts the power supply provided to the motor itself.

The user is allowed to input commands C through a suitable user interface 31 connected to the control unit 30; the user interface can comprise a push-button panel, a series of capacitive sensors, a touch screen, or any other means adapted to enable transfer of commands C to the control unit 30.

Advantageously, the control unit 30 can comprise a microprocessor, suitably programmed for performing the described control functions.

Hood 1 further comprises a feeding circuit 50 adapted to be connected to an external supply mains 60 for receiving electric power therefrom and supply electric power at least to motor 20.

Preferably, the feeding circuit 50 is also connected to the control unit 30 to provide electric power to the latter. In particular, the feeding circuit 50 provides a predetermined power supply as an output, which power supply is independent of the power supply received from the external supply mains 60. In other words, the feeding circuit 50 is adapted to receive an alternating voltage as an input, which alternating voltage can be included between 70 V and 280 V and in particular between 80 V and 265 V; the frequency of this input power supply can be included between 50 Hz and 60 Hz.

Irrespective of which is the received power supply as an input, the feeding circuit 50 outputs a power supply having predetermined features in terms of voltage and frequency.

Advantageously, the feeding circuit 50 outputs a voltage of the SELV type.

The definition of "SELV voltage" is given in the reference rule for safety IEC/EN 60335-1 concerning low-voltage household appliances.

Practically, the outputted voltage from the feeding circuit 50 is preferably included between 0 V and 42 V and, as mentioned above, can be a SELV voltage.

The fundamental principle on which operation of the feeding circuit 50 is based (switching feeder of the "step-down" type) is referred to as PWM (Pulse Width Modulation). The supply voltage received from the feeding circuit 50 as an input is first rectified (rectifier 51) and levelled/smoothed by means of a capacitor 53. Subsequently, an oscillator circuit 54 starting from this direct voltage generates an alternating voltage in the form of a series of pulses, of a constant high frequency, spaced apart a time T from each other and having a ratio between the time the pulse is ON ($T_{ON}$) and the time the pulse is zero ($T_{OFF}$) referred to as "Duty Cycle". This voltage with a varying duty cycle (PWM modulation) is applied to the ends of the primary winding of a transformer 55; the output voltage of the SELV type, present at the secondary-winding ends of transformer 55 is rectified (rectifier 56) and levelled/smoothed (capacitor 57).

The function of stabilising the output voltage of the feeding circuit 50 is obtained by feeding back the error of the output signal relative to a reference value REF.

In particular, the feeding circuit 50 is provided with a reading module 58 for reading the output voltage of the feeding circuit 50 itself, and with a comparison module 59; the latter carries out a comparison between the voltage detected by the reading module 58 and a predetermined value REF.

The difference $\epsilon$ between these values, also referred to as "error", is inputted to said oscillator circuit 54 so that the latter can vary the duty-cycle of the square wave generated, as a function of the difference between the detected voltage and the reference value.

For instance, should the voltage outputted from the feeding circuit 50 be smaller than the reference value REF, the duty-cycle would be increased while, should the voltage outputted from the feeding circuit 50 be greater than the reference value REF, the duty cycle would be decreased.

Said comparison between the output voltage read and the respective reference value REF can be performed either in a digital manner, by means of a microprocessor, or also in an analog manner, by means of an analog circuit suitably made ready for the purpose.

The feeding circuit 50 can have different independent outputs, so that it can provide power supply to a control system 52 of the motor unit 19 (to be better described in the following), the user interface 31, the possible lighting system and the possible sensor system being part of hood 1.

Due to the fact that the outlets of the feeding circuit 50 can be independent of each other, each outlet can provide a different power supply relative to the other outlets, depending on the load to be powered.

At all events, all outlets of the feeding circuit 50 preferably provide a voltage of the SELV type.

Preferably, as mentioned above, hood 1 further comprises a control system 52 for the motor. The motor control system 52 controls the output of the feeding circuit 50 and, through the control unit 30, allows feeding of the working unit 19 in accordance with the type of motor or motors 20 used.

Said motor control system 52 can have a SELV voltage both as an input and as an output.

Advantageously, the motor control system 52 can modify the output of the feeding circuit 50 to allow control of motors of different types, with or without feedback (frequency control, etc.).

Practically, through the feeding circuit 50 a power supply is provided to the ventilating motor unit 19 the features of which are defined as a function of the motor unit to be fed.

For instance, the motor control system 52 can comprise an inverter that is powered through the feeding circuit 50 and receives information on the operation mode of the motor unit 19 from the control unit 30.

Advantageously, the aforesaid inverter can be provided to be in combination with a brushless motor 20, the latter being included in the motor unit 19.

In one embodiment (not shown), the motor unit 19 can receive power supply directly from the feeding circuit 50 and commands directly from the control unit 30, without use of the motor control system 52 being provided.

In the preferred embodiment, the control unit 30 can be also dedicated to control of other devices/circuits associated with hood 1, such as: the hood lighting system 70, one or more sensors 80 adapted to enable an at least partly automatic operation of hood 1, a communication module 90 for transmitting/receiving wireless signals (to allow remote control of the operating features of hood 1), the user interface 31 and a possible display being part of same, etc.

Conveniently, the feeding circuit 50, motor unit 19 and control unit 30 can be housed at the inside of frame 10; for clarity however, in FIG. 1 only the motor unit 19 has been shown inside frame 10.

The invention achieves important advantages.

First of all operation of the hood is not bound to the voltage/frequency features of the supply mains of the Country in which the hood is marketed.

In addition, manufacture of the hood according to the invention allows use of a single common platform for goods intended for different markets.

Another advantage resides in that big savings are obtained in terms of industrial management, logistics, interventions after sale and management of the spare parts.

A further advantage is represented by the high electric efficiency.

An auxiliary advantage of the invention concerns the big energy savings, both in a stand-by condition and in a condition of normal operation of the hood.

A further advantage results from use of the SELV voltage for feeding the motor, because sizing, planning and selection of the materials for producing the motor enable safer operation of the latter. As a result of the above, a kitchen hood is obtained that can have no high-voltage part, thus increasing safety for the user of said appliance under any operating condition.

What is claimed is:

1. An extractor hood, in particular for domestic environments, comprising:

a frame (10);

a motor unit (19) associated with said frame (10) and designed to carry out air suction;

a control unit (30) for adjusting at least operation of said motor unit (19);

a feeding circuit (50) adapted to be connected to an external supply mains (60) for receiving electric power from said mains, and supplying electric power at least to said motor unit (19);

said feeding circuit (50) being suitable to output a predetermined power supply irrespective of the power supply provided by said supply mains (60) to said feeding circuit (50), said feeding circuit (50) comprising an oscillator circuit (54) having a direct voltage at its input and outputs an alternating voltage, said alternating voltage being applied to the ends of the primary winding of a transformer (55) which outputs an output voltage of SELV type, said output voltage of SELV type being stabilised by feeding back an error E of said output voltage of SELV type relative to a reference value REF wherein the feeding circuit (50) comprises a reading module (58) for reading the output voltage of SELV type, and a comparison module (59), the latter carries out a comparison between the voltage detected by the reading module (58) and said predetermined value REF.

2. A hood as claimed in claim 1, wherein said feeding circuit (50) allows one or more motor control units (52) to be electrically fed through the control unit (30), each of said motor control units (52) being able to control different types of motors, preferably selected from one or more of the following categories:

AC or DC motors;

synchronous or asynchronous motors;

motors with or without permanent magnets;

motors with or without electronic switching;

induction motors or motors without an armature;

brushless motors or motors with brushes;

frequency- voltage- or current-controlled motors.

3. A hood as claimed in claim 1, wherein said motor unit (19) comprises one or more safety extra low voltage motors.

4. A hood as claimed in claim 1, wherein said motor unit (19) comprises at least one brushless motor (20).

5. A hood as claimed in claim 1, wherein said feeding circuit (50) is connected to said control unit (30) to feed the latter with a predetermined power supply.

6. A hood as claimed in claim 1, wherein said control unit (30) is operatively active on said motor unit (19) for adjusting an operation intensity of same.

7. A hood as claimed in claim 6, wherein said control unit is configured to adjust the operation intensity of said motor unit as a function of at least one command inputted by a user.

8. A hood as claimed in claim 1, wherein said feeding circuit (50) has a plurality of outputs, each associated with a respective load, said outputs of the feeding circuit (50) being independent of each other.

9. A hood as claimed in claim 1, wherein said error E is inputted to said oscillator circuit (54) so that the latter can vary a duty-cycle of said alternating voltage generated, as a function of the difference between the output voltage of SELV type and the reference value REF.

10. A hood as claimed in claim 1, wherein said alternating voltage is in the form of a series of pulses, of a constant high frequency, spaced apart a time T from each other and having a ratio between the time the pulse is ON (TON) and the time the pulse is zero (TOFF) with a varying duty cycle.

11. A hood as claimed in claim 10, wherein said alternating voltage with a varying duty cycle is applied to the ends of the primary winding of said transformer (55), the output voltage of the SELV type, present at the secondary-winding ends of said transformer (55) is rectified by a rectifier (56) and levelled/smoothed by capacitor (57).

* * * * *

UNITED STATES PATENT AND TRADEMARK OFFICE

CERTIFICATE OF CORRECTION

PATENT NO. : 8,390,217 B2
APPLICATION NO. : 12/766460
DATED : March 5, 2013
INVENTOR(S) : Francesco Casoli It is certified that error appears in the above-identified patent and that said Letters Patent is hereby corrected as shown below:

In the Claims:

In column 5, line 24, being line 5 in Claim 1, after the word "suction" and before the ";", please insert --via the hood--.

In column 6, line 5, being line 5 in Claim 2, please delete "preferably".

Signed and Sealed this
Twenty-first Day of May, 2013

Teresa Stanek Rea
*Acting Director of the United States Patent and Trademark Office*